US005331905A

United States Patent [19]

Hammers et al.

[11] Patent Number: 5,331,905

[45] Date of Patent: Jul. 26, 1994

[54] MOTORCYCLE TIRE TABLE CONSTRUCTION

[76] Inventors: Sarah E. Hammers; Roy E. Hammers, both of 507 N. Madison, Apt. B, Siloam Springs, Ark. 72761

[21] Appl. No.: 24,281

[22] Filed: Mar. 1, 1993

[51] Int. Cl.[5] ..... A47B 83/00

[52] U.S. Cl. ..... 108/50; D6/498; 248/188.1; 108/150

[58] Field of Search ..... 301/37.43, 108.1, 108.2, 301/104; D6/498, 499; 108/150, 64, 50; 248/188.1

[56] References Cited

U.S. PATENT DOCUMENTS

| | | | |
|---|---|---|---|
| 1,729,004 | 9/1929 | Miadowicz | 248/188.1 |
| 2,829,937 | 4/1958 | Jones et al. | D6/499 X |
| 3,043,049 | 7/1962 | Gleason | 248/188.1 |
| 4,120,248 | 10/1978 | Broach | 108/23 |
| 4,685,401 | 8/1987 | Sheffer | 108/56.3 |
| 5,131,727 | 7/1992 | Johnson | 301/37.43 X |

FOREIGN PATENT DOCUMENTS

| | | | |
|---|---|---|---|
| 1068757 | 12/1979 | Canada | 248/188.1 |

*Primary Examiner*—Kenneth J. Dorner
*Assistant Examiner*—Gerald A. Anderson
*Attorney, Agent, or Firm*—E. Michael Combs

[57] ABSTRACT

A table includes a support plate including a tube arranged to mount an axle shaft therein, wherein the axle shaft includes a hub mounting a wheel member thereabout. A plurality of bumper members are mounted to an annular array onto a wheel member arranged for support of a transparent table plate thereon. The bumper members are arranged for adjusting for the ease of leveling of the table plate in use.

3 Claims, 4 Drawing Sheets

MOTORCYCLE TIRE TABLE CONSTRUCTION

BACKGROUND OF THE INVENTION

1. Field of the Invention

The field of invention relates to table construction, and more particularly pertains to a new and improved motorcycle tire table construction arranged for the employment and recycling of tire members.

2. Description of the Prior Art

Tables of various types have been utilized and constructed in the prior art and exemplified by U.S. Pat. Nos. 4,685,401 and 4,120,248.

The instant invention attempts to overcome deficiencies of the prior art by permitting the recycling and use of motorcycle tires relative to a table construction and in this respect, the present invention substantially fulfills this need.

SUMMARY OF THE INVENTION

In view of the foregoing disadvantages inherent in the known types of table construction now present in the prior art, the present invention provides a motorcycle tire table construction wherein the same is arranged for the mounting of motorcycle tires in the support of a table construction. As such, the general purpose of the present invention, which will be described subsequently in greater detail, is to provide a new and improved motorcycle tire table construction which has all the advantages of the prior art table construction and none of the disadvantages.

To attain this, the present invention provides a table including a support plate, with a tube arranged to mount an axle shaft therein, wherein the axle shaft includes a hub mounting a wheel member thereabout. A plurality of bumper members are mounted to an annular array onto a wheel member arranged for support of a transparent table plate thereon. The bumper members are arranged for adjusting for the ease of leveling of the table plate in use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved motorcycle tire table construction which has all the advantages of the prior art table construction and none of the disadvantages.

It is another object of the present invention to provide a new and improved motorcycle tire table construction which may be easily and efficiently manufactured and marketed.

It is a further object of the present invention to provide a new and improved motorcycle tire table construction which is of a durable and reliable construction.

An even further object of the present invention is to provide a new and improved motorcycle tire table construction which is susceptible of a low cost of manufacture with regard to both materials and labor, and which accordingly is then susceptible of low prices of sale to the consuming public, thereby making such motorcycle tire table construction economically available to the buying public.

Still yet another object of the present invention is to provide a new and improved motorcycle tire table construction which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
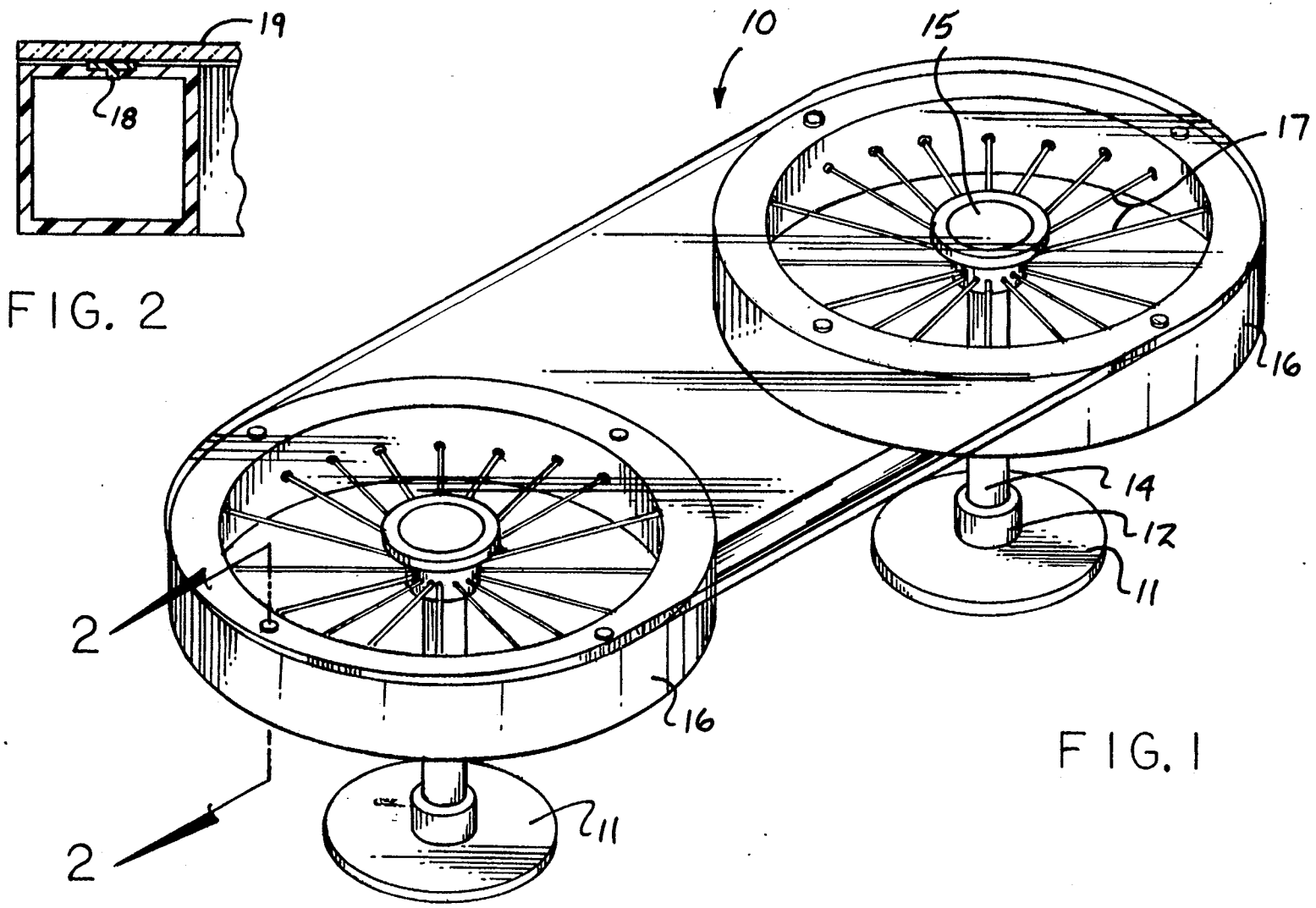
FIG. 1 is an isometric illustration of the invention.
FIG. 2 is an orthographic view, taken along the lines 2—2 of FIG. 1 in the direction indicated by the arrows.
Figure 3:
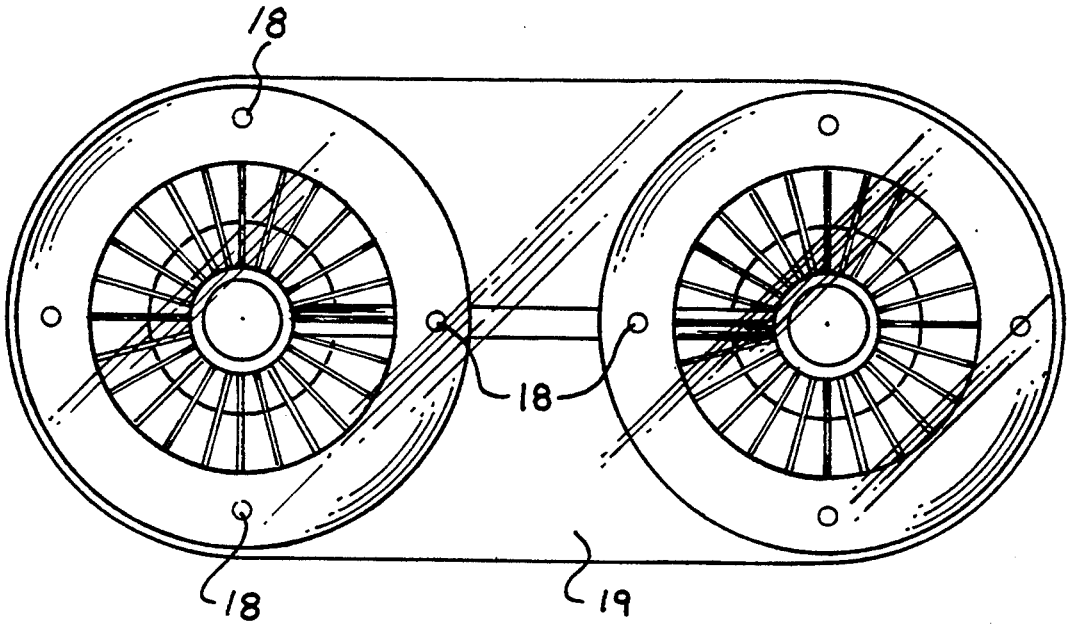
FIG. 3 is an orthographic top view of the invention.
Figure 4:
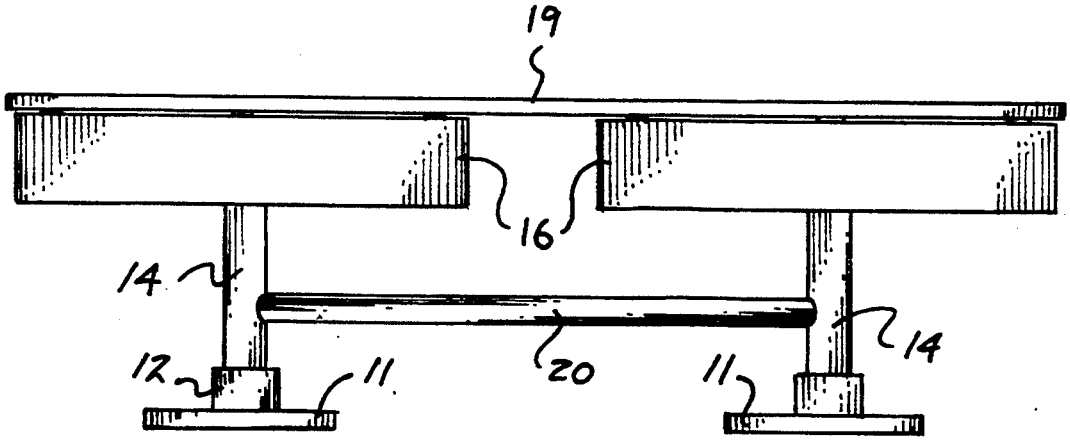
FIG. 4 is an orthographic side view of the invention.

With reference now to the drawings, and in particular to FIGS. 1 to 9 thereof, a new and improved motorcycle tire table construction embodying the principles and concepts of the present invention and generally designated by the reference numeral 10 will be described.

More specifically, the motorcycle tire table construction 10 of the instant invention essentially comprises a support plate 11, the support plate including a support plate tube 12 fixedly mounted to the support plate medially thereof, with the tube including a bearing positioned therewithin, the bearing having an axle shaft 14 directed into the bearing 13 to permit rotative mounting of the axle shaft, with the axle shaft including a hub 15 positioned exteriorly of the support tube mounting a wheel member 16 thereabout employing radial spokes 17 directed from the hub 15 to the wheel member 16. Bumper members 18 positioned in an annular array upon the wheel members 16 supports a transparent table plate 19 thereon providing for viewing of the tire member for amusement and entertainment of individuals. In the use of adjacent wheel members, a connecting tube 20 (see FIGS. 1–4) is arranged in an orthogonal relationship between adjacent axle shafts 14 preventing relative rotation of the axle shafts.

Figure 5:
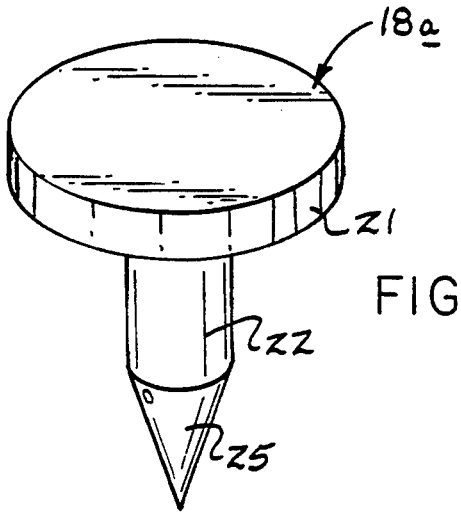
FIG. 5 is an isometric enlarged view of the use of a modified adjustable bumper plate construction.
Figure 6:
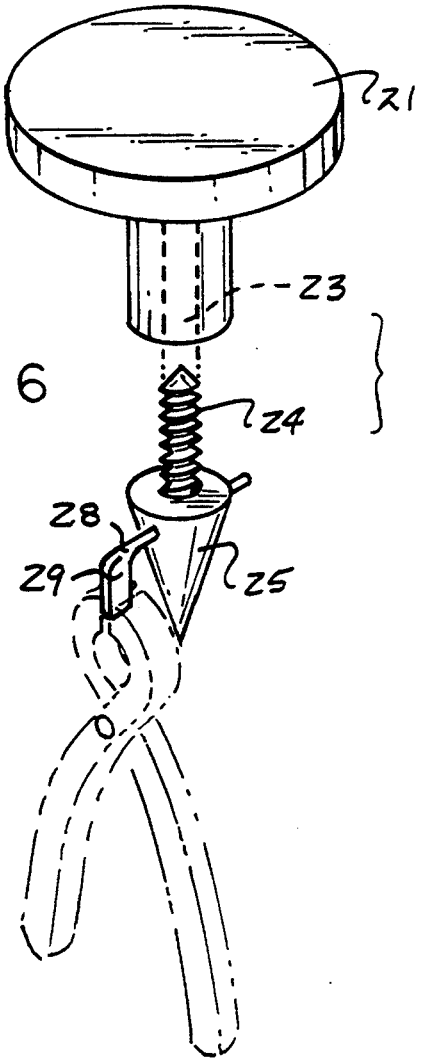
FIG. 6 is an isometric exploded view of the bumper plate structure, as indicated in FIG. 5.
Figure 7:
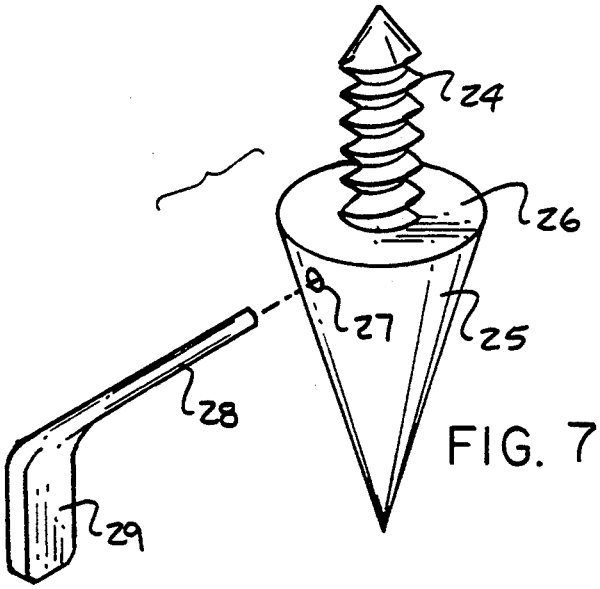
FIG. 7 is an isometric illustration of the bumper plate support foot construction.
Figure 9:
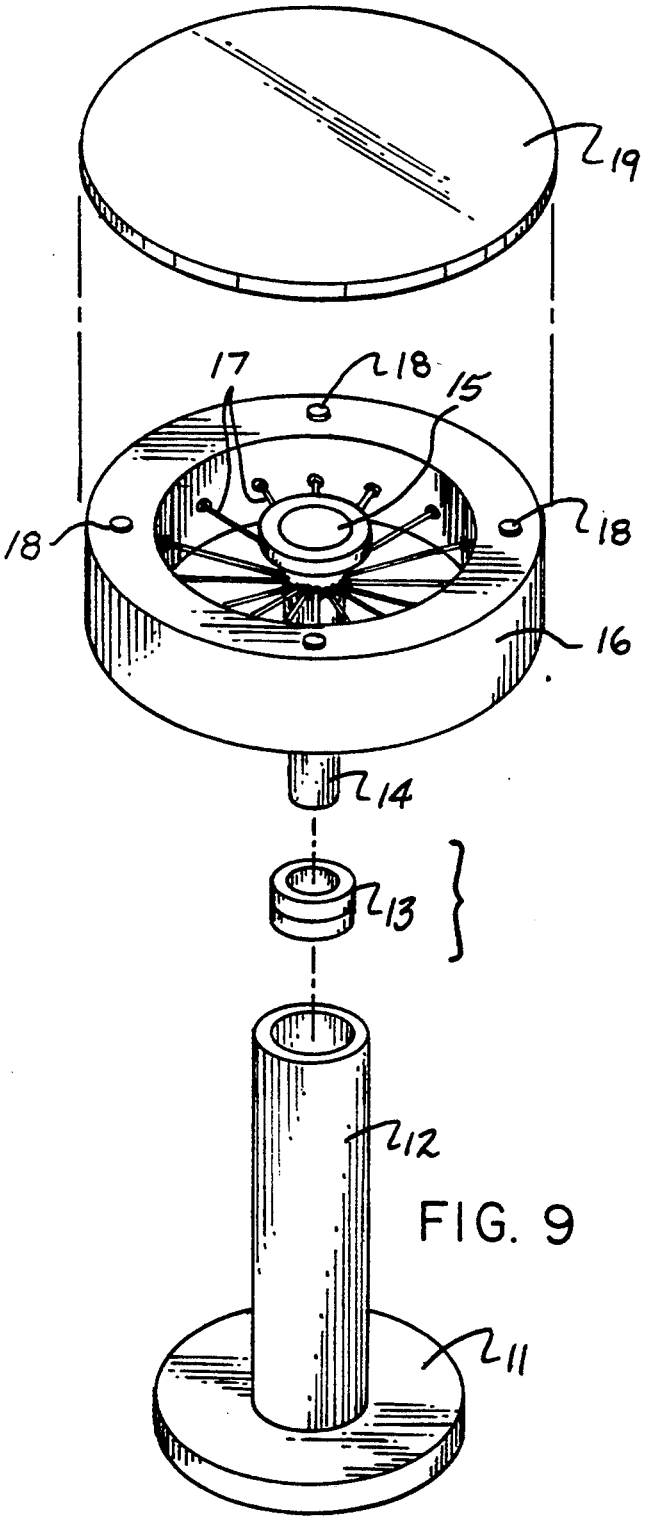
FIG. 9 is an isometric exploded view of the table construction, as indicated in FIG. 8.
Figure 8:
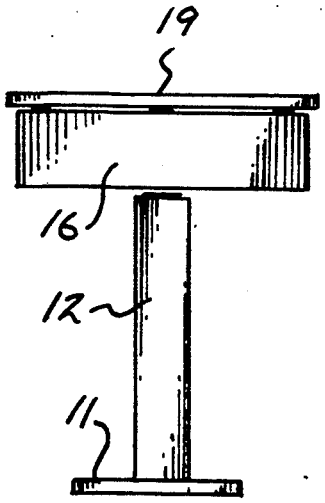
FIG. 8 is an orthographic side view of the table utilizing an individual motorcycle tire.

The FIGS. 5–7 indicates the use of a modified bumper plate construction permitting adjustment for the ease of leveling of the transparent table plate 19 to accommodate various manufacturing defects within the construction of the wheel member 16. To this end, a resilient bumper plate 21 is provided having a bumper plate tube 22 fixedly mounted medially of the bumper plate in an orthogonal relationship. The bumper plate tube 22 includes an internally threaded bore 23 arranged for reception of a threaded shank 24, wherein the threaded shank includes a conical support foot 25 fixedly mounted to a lower distal end of the threaded shank 24, with the support foot 25 including a top wall 26 mounting the threaded shank 24 integrally and orthogonally thereto. The support foot 25 includes a bore 27 directed through the support foot in an orthogonal relationship relative to the threaded shank 24 to receive a lever rod 28. The lever rod 28 slidably received within the bore 27 includes a lever rod head 29 permitting ease of grasping of the lever rod for rotation of the lever rod relative to the bumper plate 21 and the associated bumper plate tube 22 to provide for the raising or lowering of a bumper plate relative to the support foot construction 25 for the leveling of a table plate 19 by the adjustment of one or a plurality of the lever rods 28 relative to the table plate.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A motorcycle tire table construction, comprising, a table supporting leg assembly including a support plate acting as a footing and a support plate tube fixedly and orthogonally mounted to the support plate medially of the support plate, and an axle shaft received within the support plate tube, the axle shaft including a hub mounted to the axle shaft spaced from the support plate, with a wheel member mounted concentrically relative to the hub, with a plurality of spokes directed radially from the hub to the wheel member for support of the wheel member relative to the hub, and a planar transparent table plate mounted on the wheel member.

2. A table construction as set forth in claim 1 wherein an annular array of bumper members are mounted intermediate the transparent table plate and the wheel member.

3. A table construction as set forth in claim 2 wherein each of the bumper members includes a resilient bumper plate arranged for engagement with the transparent table plate, and each resilient bumper plate includes a bumper plate tube, and each bumper plate tube includes an internally threaded bore, wherein said internally threaded bore threadedly receives a threaded shank, the threaded shank having a conical support foot fixedly mounted to the threaded shank at a lowermost distal end of the threaded shank, wherein the conical support foot is arranged for engagement with the wheel member, and wherein the conical support foot includes a support foot bore directed through the conical support foot spaced from the threaded shank, and a lever rod slidably received within the threaded bore, wherein the lever rod includes a lever rod head permitting engagement of the lever rod head for rotation of the conical support foot and threaded shank relative to the bumper plate tube to permit vertical adjustment of the transparent table plate relative to the wheel member.

* * * * *